US011362455B2

(12) United States Patent
Sakoda

(10) Patent No.: US 11,362,455 B2
(45) Date of Patent: Jun. 14, 2022

(54) CONNECTOR DEVICE USING LID MEMBER, AND LID MEMBER

(71) Applicant: HIROSE ELECTRIC CO., LTD., Kanagawa (JP)

(72) Inventor: Yusuke Sakoda, Kanagawa (JP)

(73) Assignee: HIROSE ELECTRIC CO., LTD., Kanagawa (JP)

( * ) Notice: Subject to any disclaimer, the term of this patent is extended or adjusted under 35 U.S.C. 154(b) by 0 days.

(21) Appl. No.: 17/252,553

(22) PCT Filed: Jun. 14, 2019

(86) PCT No.: PCT/JP2019/023700
§ 371 (c)(1),
(2) Date: Dec. 15, 2020

(87) PCT Pub. No.: WO2020/004076
PCT Pub. Date: Jan. 2, 2020

(65) Prior Publication Data

US 2021/0257769 A1 Aug. 19, 2021

(30) Foreign Application Priority Data

Jun. 25, 2018 (JP) ..... JP2018-119777

(51) Int. Cl.
*H01R 13/447* (2006.01)
*H01R 12/71* (2011.01)
(Continued)

(52) U.S. Cl.
CPC ..... *H01R 13/447* (2013.01); *H01R 12/716* (2013.01); *H01R 13/6273* (2013.01); *H01R 24/60* (2013.01)

(58) Field of Classification Search
CPC ..... H01R 13/447
See application file for complete search history.

(56) References Cited

U.S. PATENT DOCUMENTS 5,482,476 A 1/1996 Watanabe et al.
10,381,779 B2 8/2019 Zhou et al.
(Continued)

FOREIGN PATENT DOCUMENTS

CN 2501215 Y 7/2002
CN 201226394 Y 4/2009
(Continued)

OTHER PUBLICATIONS

International Search Report (ISR) dated Aug. 13, 2019 filed in PCT/JP2019/023700.
(Continued)

*Primary Examiner* — Oscar C Jimenez
(74) *Attorney, Agent, or Firm* — Rankin, Hill & Clark LLP

(57) ABSTRACT

Provided are: a connector device using a lid member having a simple structure and reliably held on a connector; and the lid member. The connector device includes a connector having a metal shell forming at least part of a fitting space in which a partner connector is fitted, and a resin lid member provided detachably from the fitting space. The lid member includes an insertion portion to be inserted into the fitting space along the direction of fitting the partner connector into the fitting space, and a closing portion configured to close an opening of the fitting space when the insertion portion is inserted into the fitting space. The insertion portion includes an elastic piece extending from the closing portion. The elastic piece includes a protruding portion biased to an inner wall of the shell when the insertion portion is inserted into the fitting space and protruding in a biasing direction. A dent portion dented in the biasing direction β1 is formed at the inner wall. The protruding portion is fitted in the dent portion when the insertion portion is inserted into the fitting space.

20 Claims, 6 Drawing Sheets

(51) Int. Cl.
*H01R 13/627* (2006.01)
*H01R 24/60* (2011.01)

(56) References Cited

U.S. PATENT DOCUMENTS

| | | | | |
|---|---|---|---|---|
| 2007/0111583 | A1* | 5/2007 | Cuellar ..... | H05K 5/0278 439/353 |
| 2010/0227487 | A1 | 9/2010 | Masumoto et al. | |
| 2015/0162690 | A1 | 6/2015 | Kang | |
| 2018/0205177 | A1 | 7/2018 | Zhou et al. | |

FOREIGN PATENT DOCUMENTS

| | | | |
|---|---|---|---|
| CN | 202695777 | U | 1/2013 |
| CN | 106549277 | A | 3/2017 |
| CN | 206532931 | U | 9/2017 |
| JP | 6-70174 | U | 9/1994 |
| JP | 2009-158384 | A | 7/2009 |
| JP | 2010-15891 | A | 1/2010 |
| JP | 2010-205662 | A | 9/2010 |
| JP | 2015-111367 | A | 6/2015 |

OTHER PUBLICATIONS

Chinese Office Action (CNOA) dated Nov. 18, 2021 for corresponding Chinese Patent Application No. 201980039743.0.
Extended European Search Report (EESR) dated Feb. 14, 2022 for corresponding European Patent Application No. 19824614.2.

* cited by examiner

CONNECTOR DEVICE USING LID MEMBER, AND LID MEMBER

TECHNICAL FIELD

The present invention relates to a connector device using a lid member and the lid member.

BACKGROUND ART

JP-A-2010-205662 (Patent Literature 1) discloses one example of a lid member such as a cap and a connector device including the lid member and a connector. The cap is detachably attached to a fitting portion of the connector configured to receive a partner connector. Moreover, the cap further includes a tubular insertion portion to be inserted into the fitting portion, a lid portion molded integrally with the insertion portion, and a reinforcing portion reducing deformation of the insertion portion.

With the cap, entrance of, e.g., liquid and dust into the connector during the process of mounting the connector device or during transportation of a printed circuit board on which the connector device is mounted can be prevented. In addition, the lid portion of the cap allows a suction pad of a mounter to suck the connector (the connector device) and arrange the connector at a predetermined position on the printed circuit board.

For holding such a cap on the connector, a groove is formed in a length direction along an insertion direction at an outer peripheral surface of the insertion portion of the cap. Such a groove receives a tip end portion of a lock spring piece provided on a side surface of a shell of the connector. Utilizing biasing force of the lock spring piece received in the groove, the cap is held on the connector.

CITATION LIST

Patent Literature

PATENT LITERATURE 1: JP-A-2010-205662

SUMMARY OF INVENTION

Problems to be Solved by Invention

In the configuration of Patent Literature 1, the cap is held on the connector by means of engagement between the groove of the cap and the lock spring piece of the shell. However, in this method, holding force is not sufficient in some cases. For example, in a soldering process by a reflow, the cap remains attached to the shell upon use. For this reason, there is a risk that the cap is dropped due to deformation caused by heating in such a reflow process.

Moreover, for obtaining the holding force of the cap for the connector in the configuration of Patent Literature 1, a rib crossing a space inside the cap is provided at a position corresponding to the groove of the cap. Moreover, the rib is configured to receive stress of the lock spring piece. As a result, such a structure is complicated.

The present invention is intended to provide a connector device using a lid member having a simple structure and reliably held on a connector and the lid member.

Solution to Problems

In order to achieve the object described above, a connector device according to an aspect of the present invention includes: a connector including a metal shell defining at least part of a fitting space in which a partner connector is fitted; and a resin lid member provided detachably from the fitting space, in which the lid member includes an insertion portion to be inserted into the fitting space along a direction of fitting between the fitting space and the partner connector, and a closing portion configured to close an opening of the fitting space when the insertion portion is inserted into the fitting space, the insertion portion includes an elastic piece extending from the closing portion, the elastic piece includes a protruding portion biased to an inner wall of the shell when the insertion portion is inserted into the fitting space and protruding in a biasing direction, a dent portion dented in the biasing direction is formed at the inner wall, and the protruding portion is fitted in the dent portion when the insertion portion is inserted into the fitting space.

According to the connector device of this aspect, the connector device using the lid member having the simple structure and reliably held on the connector and the lid member are provided.

In the connector device of the above-described aspect, the dent portion preferably has an edge formed by the inner wall of the shell contacting the protruding portion when the protruding portion is fitted in the dent portion.

Moreover, in the connector device of the above-described aspect, two edges are, in a direction along the fitting direction, preferably formed corresponding to the protruding portion fitted in the dent portion.

Further, in the connector device of the above-described aspect, at least a portion of the protruding portion, which contacts the two edges, positioned between the two edges has a symmetrical shape in the direction along the fitting direction $\alpha 1$.

In addition, in the connector device of the above-described aspect, the dent portion may be a through-hole penetrating the shell. The through-hole described herein may be formed in such a manner that the shell in a plate shape is punched out from an inner wall side.

Moreover, in the connector device of the above-described aspect, at least a pair of elastic pieces may be provided. The pair of elastic pieces as described herein may be arranged at opposing positions on the inner wall in an in-plane direction perpendicular to the fitting direction $\alpha 1$.

Further, in the connector device of the above-described aspect, the inner wall may have a substantially rectangular shape in the in-plane direction perpendicular to the fitting direction.

In addition, in the connector device of the above-described aspect, the lid member preferably has a bisymmetrical shape.

Moreover, in the connector device of the above-described aspect, the insertion portion preferably includes a guide portion extending from the closing portion. The guide portion described herein is configured to guide, at a peripheral surface thereof, the insertion portion along the inner wall when the insertion portion is inserted into the fitting space.

Further, in the connector device of the above-described aspect, a principal surface of the closing portion may be flat.

Effects of Invention

The present invention is intended to provide the connector device using the lid member having the simple structure and reliably held on the connector and the lid member.

DESCRIPTION OF EMBODIMENTS

Hereinafter, a connector device using a lid member and the lid member according to one preferred embodiment of the present invention will be described with reference to the attached drawings. For the sake of convenience in description, only the preferred embodiment will be described. Note that such an embodiment is not intended to limit the present invention, needless to say.

Figure 1:
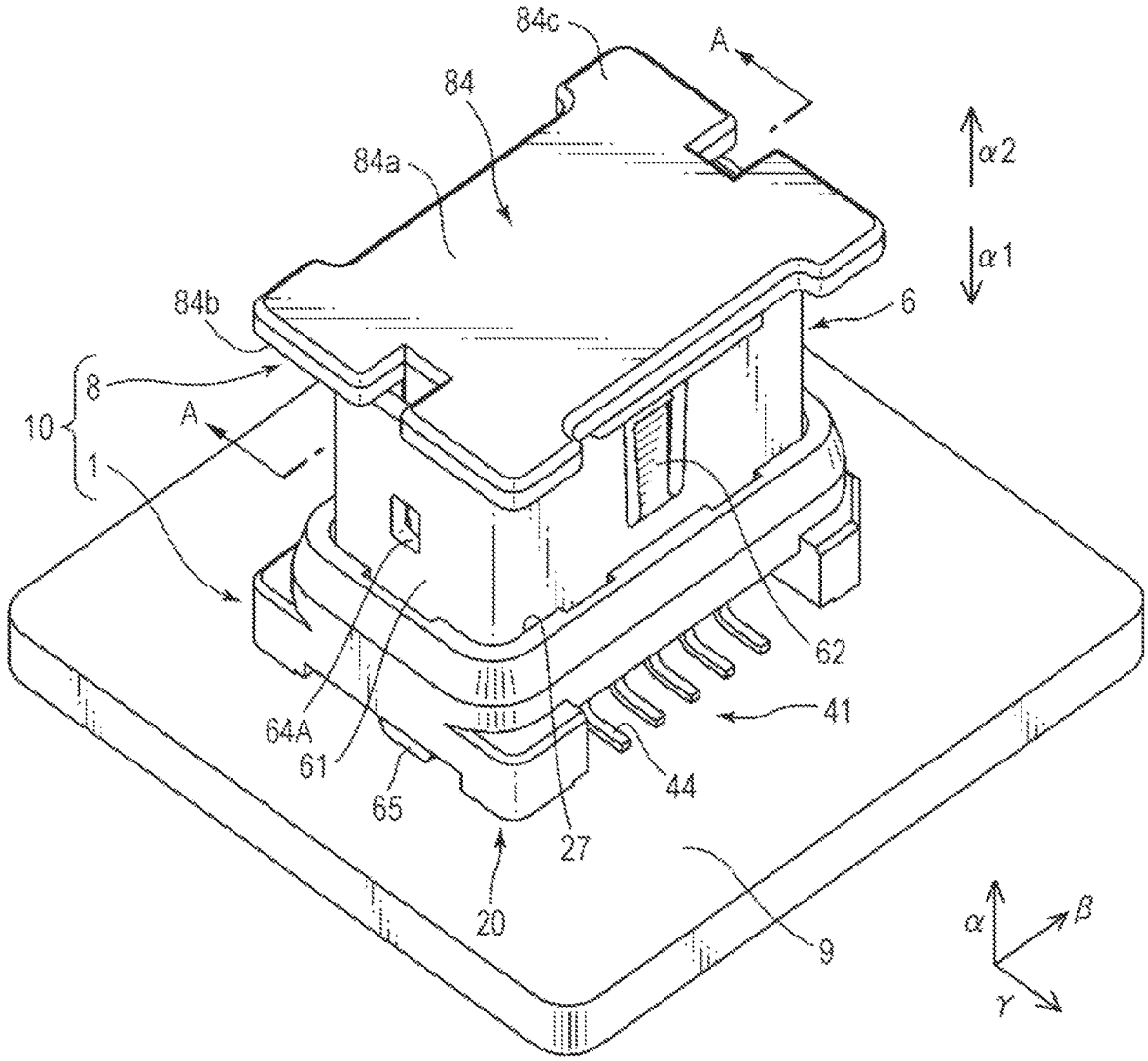
FIG. 1 is a perspective view illustrating one use form of a connector device according to one preferred embodiment of the present invention.
Figure 2:
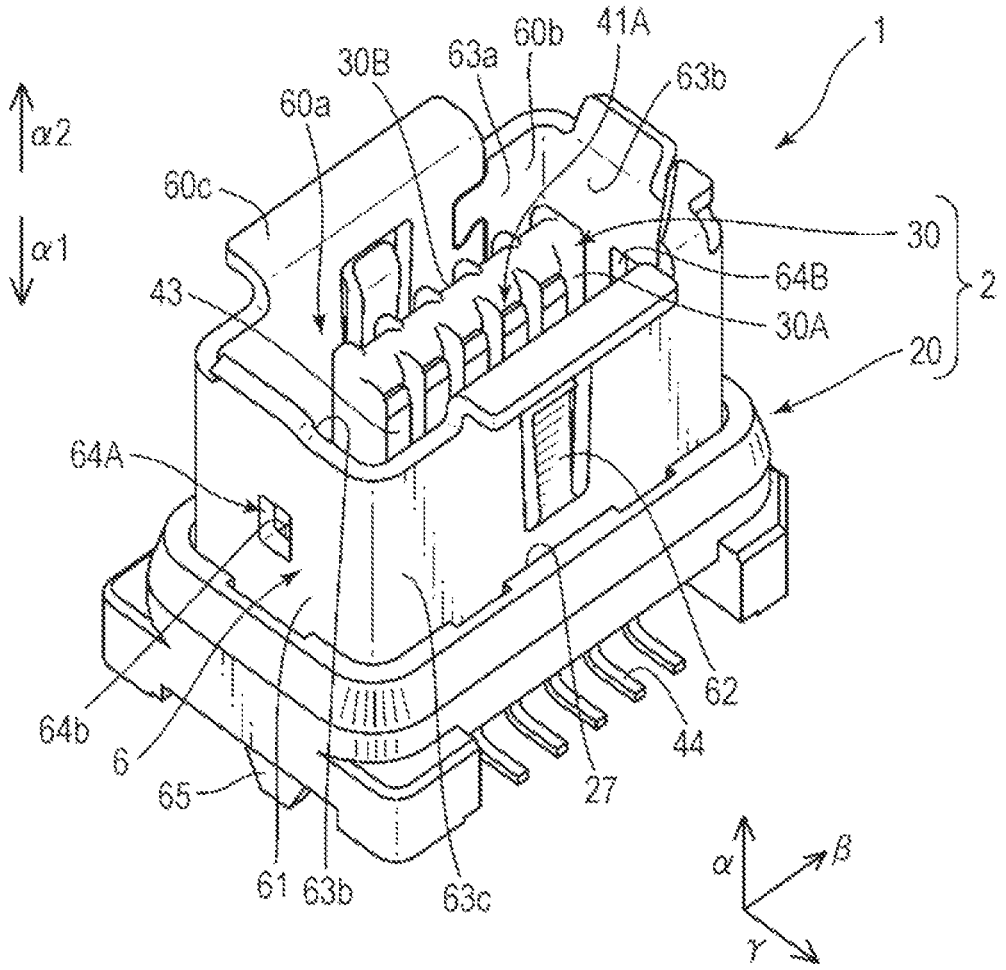
FIG. 2 is a perspective view of one example of a connector which can be used for the connector device.

FIG. 1 is a perspective view illustrating one use form of a connector device 10 according to one preferred embodiment of the present invention. In this use form, the connector device 10 is soldered to a substrate 9. FIG. 2 is a perspective view of one example of an electric connector 1 which can be used for the connector device 10. The connector device 10 illustrated in FIG. 1 is equivalent to the electric connector 1 illustrated in FIG. 2, the electric connector 1 being attached to a lid member 8 illustrated in FIG. 1. Note that the electric connector is described as an example in the present embodiment. Note that the present invention can be also applied to a connector other than the electric connector.

A partner connector (not shown) can be fitted to the electric connector 1 along a fitting direction "α1." Moreover, both connectors are separated from each other along a release direction "α2" so that the connectors can be released from each other. The lid member 8 can be also attached to the electric connector 1 along the fitting direction "α1" in a similar manner. Moreover, to lid member 8 can be separated and detached from the electric connector 1 along the release direction "α2." As clearly seen, the lid member 8 can be attached to or detached from the electric connector 1 by directly utilizing the structure of fitting to the partner connector.

The lid member 8 is attached so that entrance of, e.g., liquid or dust into the electric connector 1 during the process of mounting the connector device 10 or during transportation of a printed circuit board on which the connector device 10 is mounted can be prevented. Further, the lid member 8 is attached so that a suction pad of a mounter can suck a top surface 84*a* of a closing portion 84 of the lid member. Thus, the connector device 10 housed in a housing member such as an emboss tape (not shown) can be, for example, arranged at a predetermined position on the printed circuit board. The top surface 84*a* of the closing portion 84 is utilized as a suction surface, and therefore, is preferably flat such that, e.g., the mounter easily sucks the top surface 84*a*.

Hereinafter, a direction "α" along the fitting direction "α1" and the release direction "α2" with respect to the partner connector will be referred to as an "upper-lower direction" for the sake of convenience. Moreover, a direction "β," which is perpendicular to the upper-lower direction, along a longitudinal direction of a metal shell 6 will be referred to as a "right-left direction." Specifically, the side of fitting to and release from the partner connector will be referred to as an "upper" side with reference to the electric connector 1. Note that in the present specification, these terms "upper," "lower," "left," and "right" are merely used for the sake of convenience in distinguishing directions. For example, the "upper" and the like do not have special meanings. For this reason, the direction along the "α" direction may be, for example, referred to as the "right-left direction" (the same applies below).

It may only be required that the lid member 8 is attached to or detached from the electric connector 1 by means of the structure of fitting to the partner connector. A basic structure of the electric connector 1 is the same as that of a general electric connector. One example of the electric connector 1 described in the present specification includes a resin housing 2, multiple terminals 41 attached to the housing 2, and the metal shell 6. The direction of attaching the lid member 8 to the electric connector 1 or detaching the lid member 8 from the electric connector 1 is the same as the "α" direction along the fitting direction "α1" and the release direction "α2." Moreover, the direction of attachment/detachment of the lid member 8 and the "α" direction are both perpendicular to the substrate 9. The direction of attachment/detachment of the lid member 8 is set to such a direction, and therefore, the electric connector 1 to which the lid member 8 is attached, i.e., the connector device 10, can be moved to a desired position on the substrate 9 by means of the mounter.

The housing 2 includes a flat substantially-rectangular-parallelepiped base 20 and a thin plate-shaped body 30 standing to extend upward of the base 20, i.e., extend to the side of fitting to the partner connector. Components of the electric connector 1 including the housing 2 have approximately bisymmetrical shapes, except for the plate-shaped body 30. The plate-shaped body 30 has a point symmetrical shape as viewed in plane. Note that as in other portions, the plate-shaped body 30 may have a bisymmetrical shape.

The plate-shaped body 30 may be extremely thin. The thickness of the plate-shaped body 30 may be, for example, about 1 to 3 mm. On one plate surface 30A and the other plate surface 30B of the plate-shaped body 30 facing each other in a thickness direction "γ" of the plate-shaped body 30, multiple first terminals 41A and multiple second terminals 41B, i.e., five first terminals 41A and five second terminals 41B in total in this embodiment (see, e.g., FIG. 8 as described later), are arrayed. All of these terminals have the same shape. Note that all of these terminals do not necessarily have the same shape. Needless to say, the number of terminals is not necessarily five. Considering prevention of crosstalk, the first terminals 41A and the second terminals 41B are arrayed in a zigzag pattern on the plate-shaped body 30. Each terminal 41 includes a contact portion 43 contactable with the partner connector and a mounting portion 44 to be soldered to a predetermined substrate portion.

The shell 6 includes a main body 61 formed in a substantially tubular shape. Directing portions 60*c* opening to the outside so that the partner connector can be directed into an opening 60*b* of the main body 61 are provided at an end portion of the opening 60*b* on the side of fitting to the partner connector. The directing portions 60*c* are, one by one, provided at the total of four locations at the sides of the substantially rectangular main body 61 as viewed in the plane. On the other hand, at an end portion of the main body 61 on a side opposite to the side of fitting to the partner connector, a pair of fixing pieces 65 extending to the side of attachment to the housing 2 is provided. The shell 6 is configured such that the end portion 61*a* (see FIG. 7 as described later) of the main body 61 on the side opposite to the side of fitting to the partner connector is inserted and placed into an annular recessed groove 27 provided at the housing 2. In addition, the fixing pieces 65 are press-fitted in through-holes 26 (see FIG. 7 as described later) of the housing 2 such that the shell 6 is fixed to the housing 2.

When the shell 6 is placed at a predetermined position on the housing 2, fitting space 60*a* in which part of the partner connector is fitted is formed between an inner wall 63*a* of the main body 61 and the plate-shaped body 30 of the housing 2, The inner wall 63*a* of the shell 6 defining the fitting space 60*a* has a substantially rectangular shape in an in-plane direction "β-γ" perpendicular to the fitting direction "α1." A pair of lock holes 64A, 64B is, at the main body 61, provided as through-holes penetrating the main body 61. Predetermined portions of the partner connector fitted in the fitting space 60*a* are locked at the pair of lock holes 64A, 64B. Moreover, the pair of lock holes 64A, 64B is positioned at opposing peripheral walls of the main body 61, which is in the rectangular shape as viewed in plane, in the longitudinal direction "β," i.e., the opposing end portions of the main body 61 in the direction "β" of arraying the multiple first terminals 41A or the multiple second terminals 41B. As described later, these lock holes 64A, 64B also have an important function when the lid member 8 is attached to the electric connector 1.

Holding pieces 62 are provided at an outer wall of the main body 61. The holding piece 62 includes part of a wall surface of the shell 6 cut, raised, and slightly bent inward. With the holding pieces 62, the partner connector fitted in the fitting space 60*a* can electrically contact the shell 6. The partner connector can be, for example, connected to ground through such contact.

The structure and function of the lid member 8 will be described in detail with reference to FIGS. 3 to 8.

Figure 5:
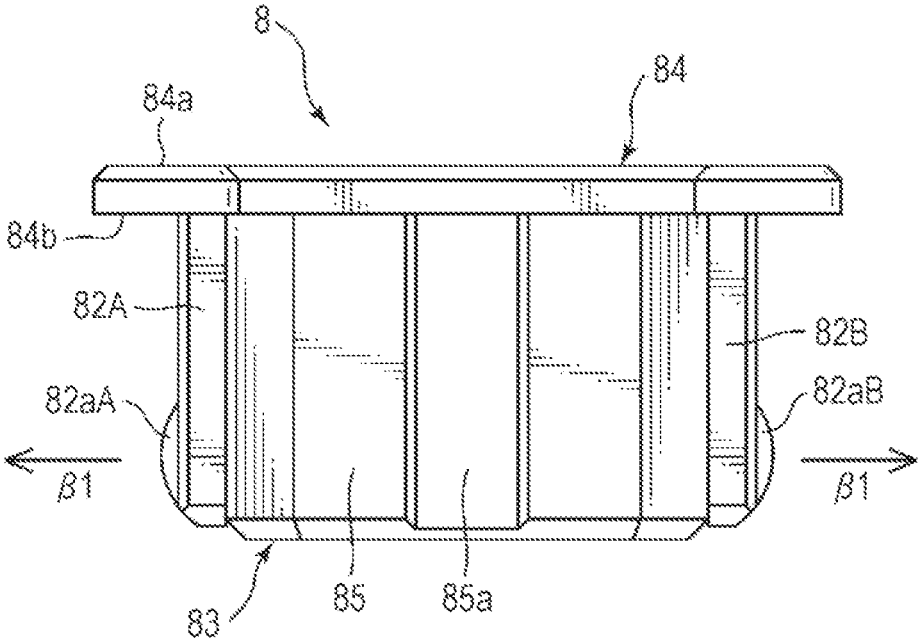
FIG. 5 is a side view of the lid member.
Figure 6:
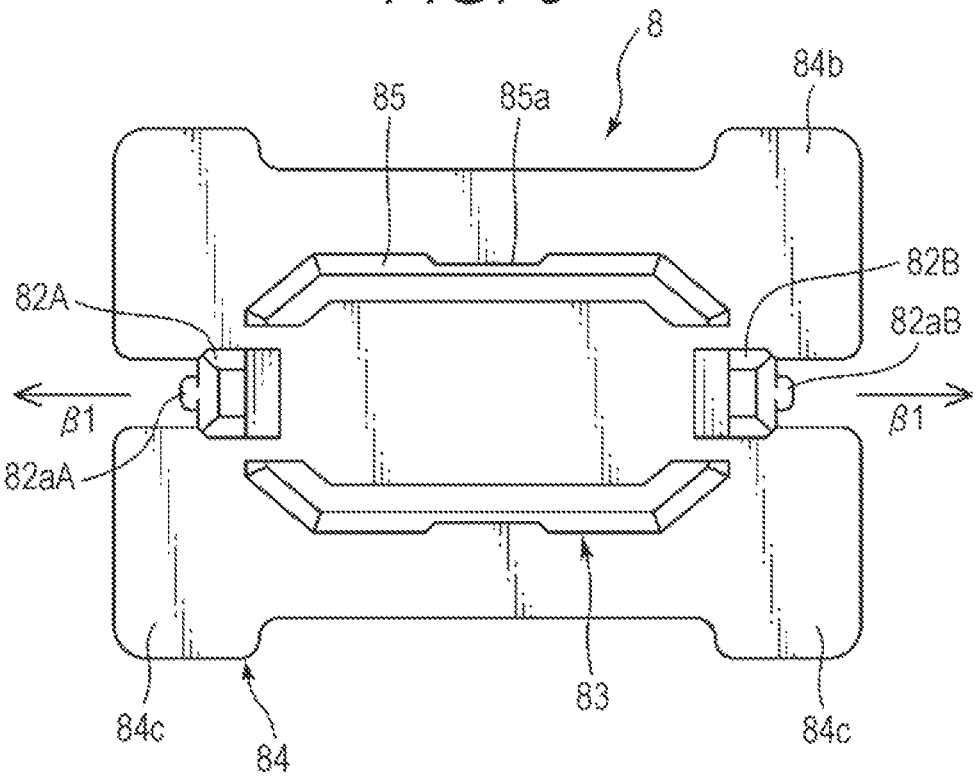
FIG. 6 is a bottom view of the lid member.
Figure 7:
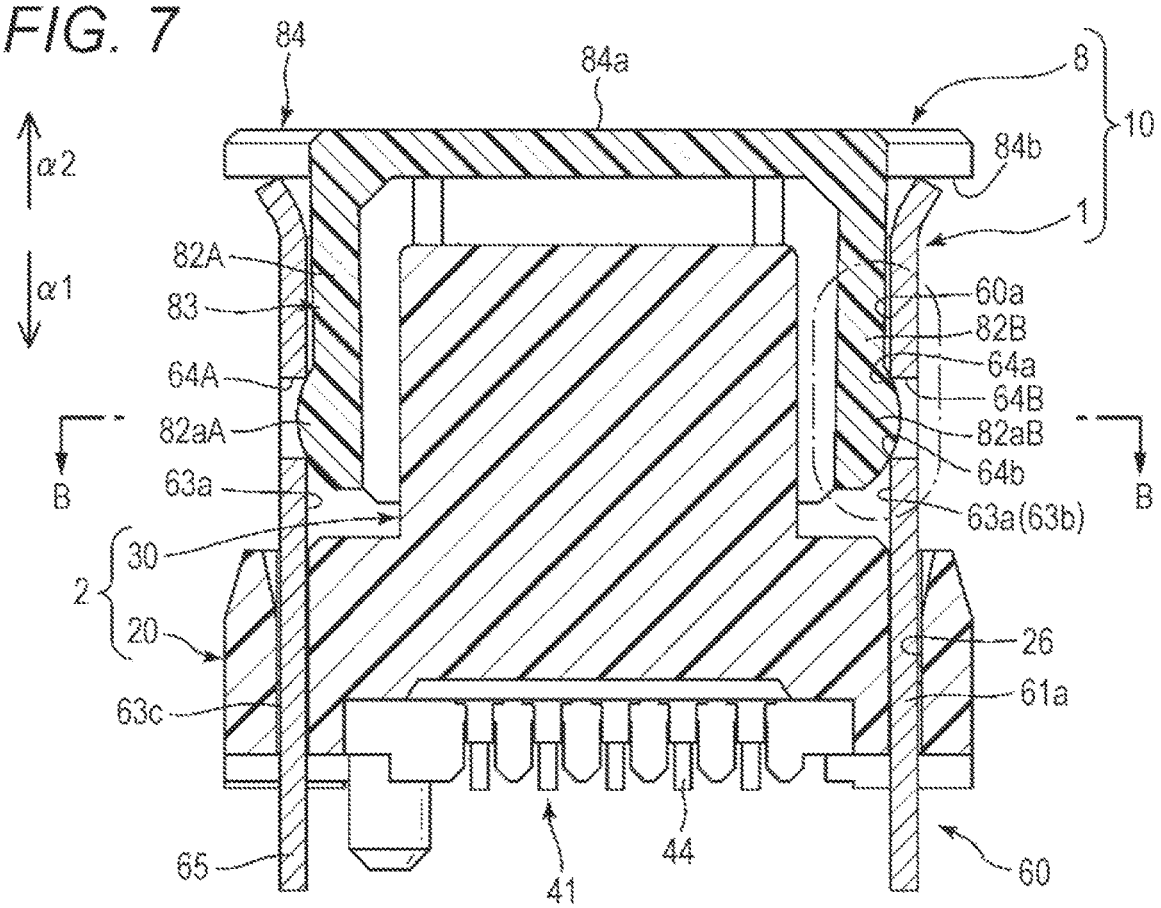
FIG. 7 is a sectional view along an A-A line of FIG. 1.
Figure 8:
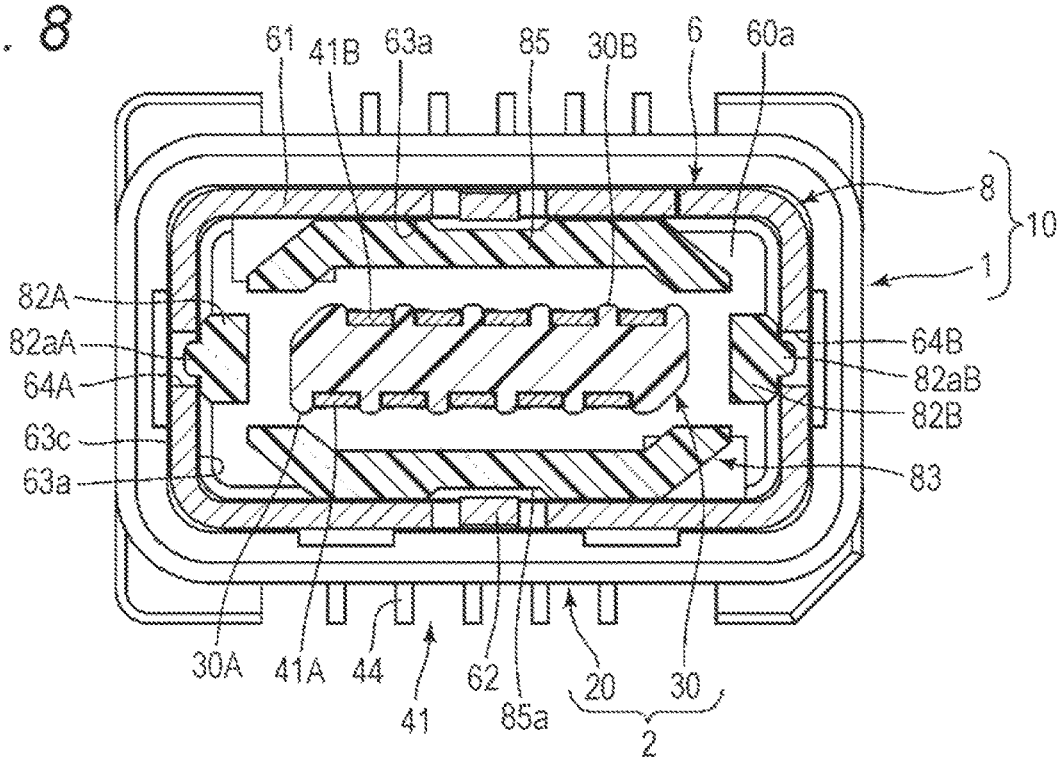
FIG. 8 is a sectional view along a B-B line of FIG. 7.

FIGS. 3 to 6 are views of the individual lid member 8. FIGS. 7 to 8 are sectional views of the electric connector device 10 having the lid member 8 attached to the electric connector 1.

Figure 3:
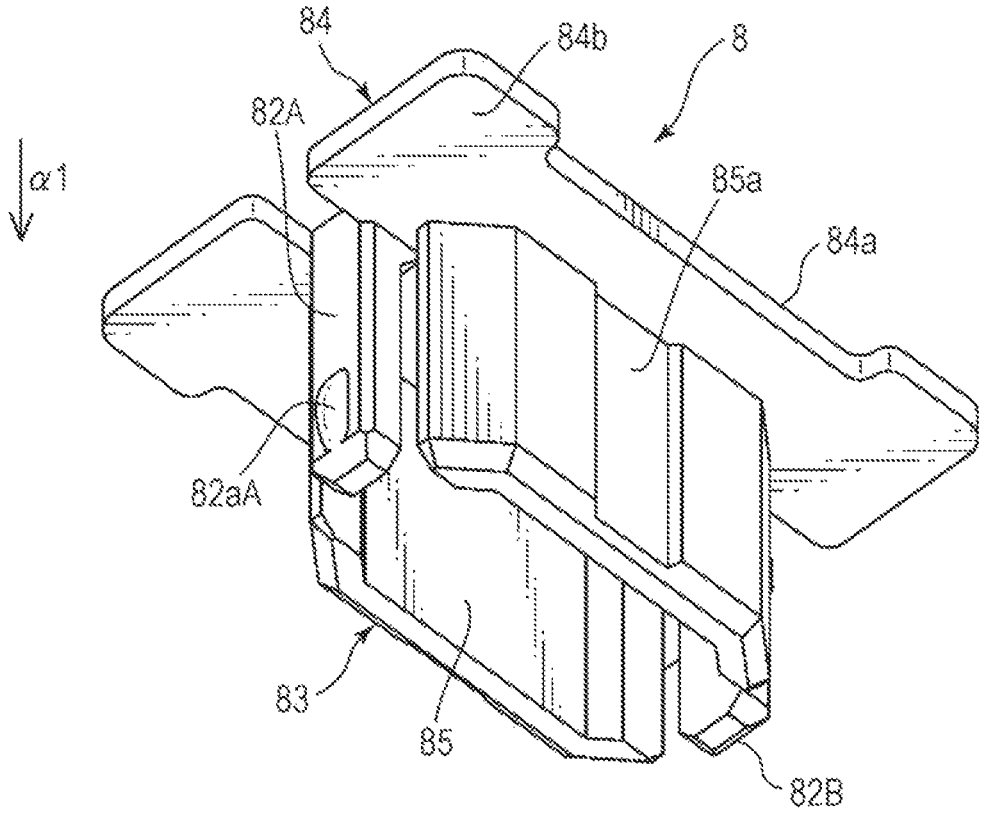
FIG. 3 is a perspective view of a lid member.
Figure 4:
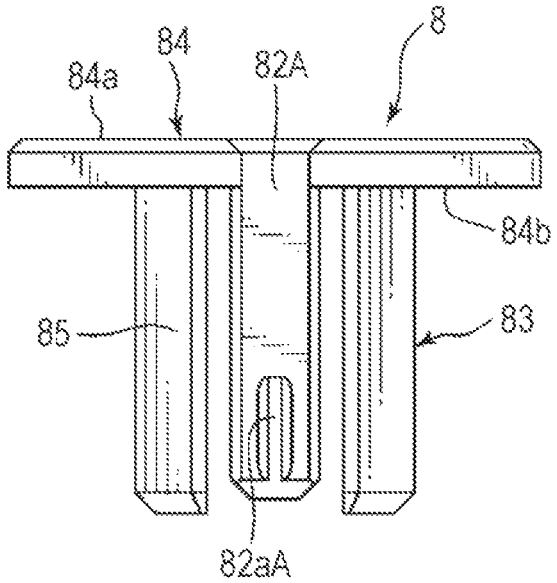
FIG. 4 is a front view of the lid member.
Figure 9:
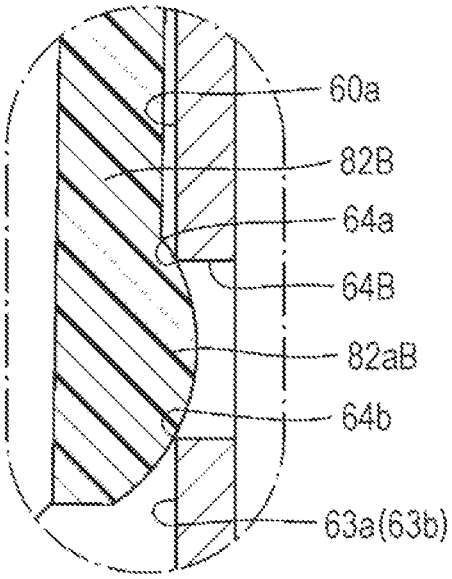
FIG. 9 is a partially-enlarged view of FIG. 7.

More specifically, FIG. 3 is a perspective view of the lid member 8. FIG. 4 is a front view of the lid member 8. FIG. 5 is a cross-sectional view of the lid member 8, FIG. 6 is a bottom view of the lid member 8. Moreover, FIG. 7 is a sectional view along an A-A line of FIG. 1. FIG. 8 is a sectional view along a B-B line of FIG. 7. FIG. 9 is a partially-enlarged view of FIG. 7.

As illustrated in, e.g., FIGS. 3 to 6, the lid member 8 has a bisymmetrical shape. Thus, in a case where the fitting space 60*a* of the electric connector 1, more specifically an outline defined by the inner wall 63*a* in the in-plane direction "β-γ" perpendicular to the fitting direction "α1," is in a bisymmetrical shape as in the lid member 8, when the lid member 8 is attached to the fitting space 60*a* of the electric connector 2, the directions of these components cause no problem. Thus, such a configuration can eliminate complexity in handling.

The lid member 8 can be formed from a non-conductive member such as resin. A preferred resin material can be relatively softly deformed upon contact with the shell 6, but have hardness to such an extent that the resin material cannot be easily shaved off by the shell 6.

The lid member 8 includes an insertion portion 83 and the closing portion 84. The insertion portion 83 and the closing portion 84 may be manufactured by integral molding. When the lid member 8 is attached to the electric connector 1, the insertion portion 83 is inserted into the fitting space 60*a* along the direction "α1" of fitting the partner connector in the fitting space 60*a*. Moreover, when the insertion portion 83 is inserted into the fitting space 60*a*, the closing portion 84 closes the opening 60*b* of the fitting space 60*a*. Further, a bottom surface 84*b* of the closing portion 84 contacts top portions of the directing portions 60*c*.

The closing portion 84 is a plate-shaped member having an area slightly larger than that of the opening 60*b* of the fitting space 60*a*. The lid member 84 has a substantially rectangular shape in the in-plane direction "β-γ" perpendicular to the fitting direction "α1," the substantially rectangular shape corresponding to the shape of the inner wall 63*a* of the shell 6 which defines at least part of the fitting space 60*a*. Note that it may only be required that the closing portion 84 has such size and shape that the closing portion 84 can close the opening 60*a* of the fitting space 60*a*. The closing portion 84 does not necessarily have the area larger than the opening 60*b*. Moreover, the shape of the closing portion 84 is not specifically limited. For facilitating detachment of the lid 8 from the electric connector 1, operation protruding portions 84*c* expanding outward are provided at four corners of the closing portion 84.

The insertion portion 83 includes at least a pair of elastic pieces 82A, 82B extending from the bottom surface 84*b* of the closing portion 84. The pair of elastic pieces 82A, 82B is arranged at positions facing each other along the inner wall 63*a* of the shell 6. For example, the pair of elastic pieces 82A, 82B is, in the in-plane direction "β-γ" perpendicular to the fitting direction "α1," arranged at opposing positions in a longitudinal direction of a substantially rectangular parallelepiped shape formed by the inner wall 63*a* of the shell 6 defining the fitting space 60*a*. Protruding portions 82*a*A, 82*a*B are provided at tip ends of the elastic pieces 82A, 82B, i.e., at end portions farther from the lid portion 84. When the insertion portion 83 is inserted into the fitting space 60*a*, the protruding portions 82*a*A, 82*a*B are biased toward the inner wall 63*a* of the shell 60. The protruding portions 82*a*A, 82*a*B protrude in such a biasing direction.

The insertion portion 83 further includes a guide portion 85 extending from the closing portion 8. The guide portion 85 is formed in a substantially annular shape in the in-plane direction "β-γ" perpendicular to the fitting direction "α1." That is, the guide portion 85 is along the outline formed by the inner wall 63*a* of the shell 6 defining the fitting space 60*a*, and corresponds to a wall surface of the plate-shaped body 30. For forming the substantially-closed outline of the guide portion 85 in the in-plane direction "β-γ," part of such a closed outline is complemented by the pair of elastic pieces 82A, 82B. When the insertion portion 83 is inserted into the fitting space 60*a*, the guide portion 85 contacts, at a peripheral surface thereof, the inner wall 63*a* to guide the insertion portion 83 into the fitting space 60*a*. At part of an outer surface of the guide portion 85, recessed portions 85*a* dented to a fitting space 60*a* side are formed. When the guide portion 85 is inserted into the fitting space 60*a*, the holding pieces 62 (see FIG. 2) provided on the wall surface of the shell 6 engage with the recessed portions 85*a*. This can more effectively prevent detachment of a lid portion 8 from the fitting space 60*a*.

As illustrated in, e.g., FIGS. 7 to 9, dent portions such as the lock holes 64A, 64B are, at the inner wall 63*a* forming the fitting space 60*a*, formed corresponding to the protruding portions 82*a*A, 82*a*B provided at the tip ends of the elastic pieces 82A, 82B. When the insertion portion 83 is inserted into the fitting space 60*a*, the protruding portions 82*a*A, 82*a*B each provided at the pair of elastic pieces 82A, 82B are fitted in these dent portions. With this configuration, the lid member 8 can be reliably held on the electric connector 1.

At these dent portions such as the lock holes 64A, 64B, edges 64*a*, 64*b* contacting the protruding portions 82*a*A,

82*a*B when these protruding portions 82*a*A, 82*a*B are fitted in the dent portions are preferably formed. The edges 64*a*, 64*b* are formed so that the protruding portions 82*a*A, 82*a*B can be reliably engaged with the dent portions. Thus, the lid member 8 can be more reliably held on the electric connector 1. For much more reliably holding the lid member 8, two edges 64*a*, 64*b* are, in the direction "α" along the fitting direction "al," preferably formed corresponding to the protruding portions 82*a*A, 82*a*B fitted in the dent portions.

Of each of the protruding portions 82*a*A, 82*a*B contacting these two edges 64*a*, 64*b*, a portion positioned between these two edges 64*a*, 64*b* preferably has a symmetrical shape in the direction "α" along the fitting direction "α1." With the symmetrical shape, force on the protruding portions 82*a*A, 82*a*B is equally dispersed at each of the protruding portions 82*a*A, 82*a*B. Thus, a probability that the protruding portions 82*a*A, 82*a*B are shaved off by the edges 64*a*, 64*h* can be reduced. Further, a disadvantage that shavings interfere with electrical connection can be reduced.

It may only be required that the dent portions are dented from the inner wall 63*a* in the biasing direction β1 so that the protruding portions 82*a*A, 83*a*B can be fitted in the dent portions when the insertion portion 83 is inserted into the fitting space 60*a*. The dent portions are not necessarily the through-holes such as the lock holes 64A, 64B. That is, the dent portions may be merely-recessed portions. However, in a case where the dent portions are formed as the through-holes such as the lock holes 64A, 64B, these through-holes can be easily provided in such a manner that the shell 6 is punched out. In this case, the through-holes are punched out from an inner wall 63*a* side of the shell 60. By punching out from the inner wall 63*a* side, a burr surface formed due to such punching out is formed on an outer wall 63*c* of the shell 60, whereas a shear droop surface is formed on the inner wall 63*a* of the shell 60. Thus, the edges 64*a*, 64*b* are formed by the "shear droop surfaces." This can reduce the probability that the protruding portions 82*a*A, 82*a*B are shaved off by the edges 64*a*, 64*b*.

Needless to say, the dent portions are not necessarily the portions at which the predetermined portions of the partner connector are locked, such as the lock holes 64A, 64B. Note that the portions provided for the purpose of locking the predetermined portions of the partner connector, such as the lock holes 64A, 64B, may be utilized as the dent portions. In other words, portions provided for a purpose other than the purpose for fitting the protruding portions 82*a*A, 83*a*B may be utilized as the dent portions. In this case, the dent portions are not necessarily provided for fitting the protruding portions 82*a*A, 83*a*B. Thus, complexity in manufacturing can be eliminated.

Description above relates to the preferred embodiment. That is, it should be understood that description above merely represents an article and the method for manufacturing the article. It can be recognized that modification and correction into different embodiments are obvious to those skilled in the art in light of teaching above. Thus, exemplary embodiments and substitute embodiments can be implemented without departing from the spirit of the article and the method described in the attached claims.

LIST OF REFERENCE SIGNS

1 Electric connector
2 Housing
5 Shield
8 Lid member
20 Base

The invention claimed is:

1. A connector device comprising:
a connector including a metal shell defining at least part of a fitting space in which a partner connector is fitted; and
a resin lid member provided detachably from the fitting space,
wherein the lid member includes
an insertion portion to be inserted into the fitting space along a direction of fitting between the fitting space and the partner connector, and
a closing portion configured to close an opening of the fitting space when the insertion portion is inserted into the fitting space,
the insertion portion includes an elastic piece extending from the closing portion,
the elastic piece includes a protruding portion biased to an inner wall of the shell when the insertion portion is inserted into the fitting space and protruding in a biasing direction,
a dent portion dented in the biasing direction is formed at the inner wall,
the protruding portion is fitted in the dent portion when the insertion portion is inserted into the fitting space, and
the dent portion is a through-hole penetrating the shell and is formed in such a manner that the shell in a plate shape is punched out from an inner wall side.

2. The connector device according to claim 1, wherein
the dent portion has an edge contacting the protruding portion when the protruding portion is fitted in the dent portion and formed by the inner wall of the shell.

3. The connector device according to claim 2, wherein
the edge includes two edges formed, in a direction along the fitting direction, corresponding to the protruding portion fitted in the dent portion.

4. The connector device according to claim 3, wherein
of the protruding portion contacting the two edges, at least a portion positioned between the two edges has a symmetrical shape in the direction along the fitting direction.

5. The connector device according to claim 1, wherein
the elastic piece includes at least a pair of elastic pieces, and
the pair of elastic pieces is arranged at opposing positions on the inner wall in an in-plane direction perpendicular to the fitting direction.

6. The connector device according to claim 1, wherein
the inner wall has a substantially rectangular shape in the in-plane direction perpendicular to the fitting direction.

7. The connector device according to claim 1, wherein
the lid member has a bisymmetrical shape.

8. The connector device according to claim 1, wherein
the insertion portion includes a guide portion extending from the closing portion, and
the guide portion guides, at a peripheral surface thereof, the insertion portion along the inner wall when the insertion portion is inserted into the fitting space.

9. The connector device according to claim 1, wherein
a principal surface of a top surface of the closing portion is flat.

10. A lid member used for the connector device according to claim 1.

11. A connector device comprising:
a connector including a metal shell defining at least part of a fitting space in which a partner connector is fitted; and a resin lid member provided detachably from the fitting space, wherein the lid member includes an insertion portion to be inserted into the fitting space along a direction of fitting between the fitting space and the partner connector, an outer surface of the insertion portion is in direct contact with an inner surface of the shell, and a closing portion configured to close an opening of the fitting space when the insertion portion is inserted into the fitting space, the insertion portion includes an elastic piece extending from the closing portion, the elastic piece includes a protruding portion biased to the inner surface of the shell when the insertion portion is inserted into the fitting space and protruding in a biasing direction, a dent portion dented in the biasing direction is formed at the inner surface of the shell, and the protruding portion is fitted in the dent portion when the insertion portion is inserted into the fitting space.

12. The connector device according to claim 11, wherein the dent portion has an edge contacting the protruding portion when the protruding portion is fitted in the dent portion and formed by the inner surface of the shell.

13. The connector device according to claim 12, wherein the edge includes two edges formed, in a direction along the fitting direction, corresponding to the protruding portion fitted in the dent portion.

14. The connector device according to claim 13, wherein of the protruding portion contacting the two edges, at least a portion positioned between the two edges has a symmetrical shape in the direction along the fitting direction.

15. The connector device according to claim 11, wherein the elastic piece includes at least a pair of elastic pieces, and the pair of elastic pieces is arranged at opposing positions on the inner surface in an in-plane direction perpendicular to the fitting direction.

16. The connector device according to claim 11, wherein the inner surface has a substantially rectangular shape in the in-plane direction perpendicular to the fitting direction.

17. The connector device according to claim 11, wherein the lid member has a bisymmetrical shape.

18. The connector device according to claim 11, wherein the insertion portion includes a guide portion extending from the closing portion, and the guide portion guides, at a peripheral surface thereof, the insertion portion along the inner surface when the insertion portion is inserted into the fitting space.

19. The connector device according to claim 11, wherein a principal surface of a top surface of the closing portion is flat.

20. A lid member used for the connector device according to claim 11.

* * * * *